US007875581B2

(12) United States Patent
Chiba et al.

(10) Patent No.: US 7,875,581 B2
(45) Date of Patent: Jan. 25, 2011

(54) LUBRICANT COMPOSITION FOR RESIN CONVEYOR AND METHOD FOR USING SAME

(75) Inventors: Tsunenori Chiba, Yokohama (JP); Masaki Yamada, Yokohama (JP); Wataru Ebine, Yokohama (JP)

(73) Assignee: Diversey, Inc., Sturtevant, WI (US)

( * ) Notice: Subject to any disclaimer, the term of this patent is extended or adjusted under 35 U.S.C. 154(b) by 343 days.

(21) Appl. No.: 12/091,136

(22) PCT Filed: Oct. 26, 2006

(86) PCT No.: PCT/US2006/042309

§ 371 (c)(1), (2), (4) Date: Aug. 8, 2008

(87) PCT Pub. No.: WO2007/051011

PCT Pub. Date: May 3, 2007

(65) Prior Publication Data

US 2009/0029886 A1 Jan. 29, 2009

(30) Foreign Application Priority Data

Oct. 26, 2005 (JP) ..... 2005-311874

(51) Int. Cl.
*C10M 107/34* (2006.01)

(52) U.S. Cl. ..... 508/579; 508/580

(58) Field of Classification Search ..... 508/579, 508/580

See application file for complete search history.

(56) References Cited

U.S. PATENT DOCUMENTS

| | | | |
|---|---|---|---|
| 2006/0046940 | A1 | 3/2006 | Almalki et al. |
| 2006/0211584 | A1 | 9/2006 | Court et al. |

FOREIGN PATENT DOCUMENTS

| | | |
|---|---|---|
| JP | 01-096294 | 4/1989 |
| JP | 10-158681 | 6/1998 |
| WO | 01/23504 | 4/2001 |
| WO | 01/88071 | 11/2001 |

OTHER PUBLICATIONS

The International Search Report from the European Patent Office.

*Primary Examiner*—Walter D Griffin
*Assistant Examiner*—Frank C Campanell
(74) *Attorney, Agent, or Firm*—Gregory S. Bollis

(57) ABSTRACT

A lubricant composition for a resin conveyor, comprising specific (A) a nonionic surfactant and (B) water and, if necessary, (C) (a) a cationic surfactant and/or (b) an amphoteric surfactant, and a method for using same. Using a specific nonionic surfactant as the main component provides excellent washing ability, lubricating ability, and stability in storage. In particular, because excellent ability to prevent stress cracking is attained, the lubricant composition for a resin conveyor can be advantageously employed for transporting PET containers. Furthermore, adding a specific cationic surfactant makes it possible to obtain a lubricant composition for a resin conveyor also demonstrating an effect of inhibiting microorganism (fungi) generation, without degrading the various original performances (effects). Furthermore, a preferred method for using those lubricant compositions for resin conveyors is also provided.

14 Claims, No Drawings

LUBRICANT COMPOSITION FOR RESIN CONVEYOR AND METHOD FOR USING SAME

TECHNICAL FIELD

The present invention relates to a lubricant composition for a resin conveyor used for transporting steel cans, aluminum cans, glass bottles, paper containers, and in particular polyalkylene terephthalate containers in the process of manufacturing and filling tea, coffee, black tea, milk beverages, carbonated refreshing beverages, and seasonings. More particularly, the present invention relates to a lubricant composition for a resin conveyor that excels in washing ability and lubricating ability and prevents stress cracking of polyalkylene terephthalate containers, and to a method for using the same.

BACKGROUND ART

In recent years, containers from polyalkylene terephthalates such as polyethylene terephthalate (referred to hereinbelow as "PET containers") have been widely used as containers for beverages such as tea, coffee, black tea, milk beverages, and carbonated refreshing beverages.

Furthermore, in addition to conveyors from metallic materials such as stainless steel, conveyors from resin materials such as polyacetal resins, polypropylene resins, polyethylene resins, acrylonitrile-butadiene-styrene resins, etc. (referred to hereinbelow as "resin containers") have been used in the processes of manufacturing and filling the beverages.

Resin conveyors are usually used for transporting PET containers in the process of filling the containers with the above-described beverages.

Resin conveyors are continuously operated under automatic control. As a result, even when the flow of PET containers is stopped, the resin conveyor alone continuous operating. In this case the dynamic friction force between the PET container and conveyor surface has to be decreased.

Further, an appropriate static friction force is required for the conveyor surface in order to place the PET containers that were supplied from a washing machine directly onto the flow of resin conveyor.

For this purpose, Japanese Patent Application Laid-open No. H1-96294 has discloses a lubricant composition comprising a higher fatty acid soap as the main component and optionally a surfactant obtained by compounding a cationic surfactants having Bactericidal ability and a nonionic surfactant. Such lubricant composition is used by diluting with water to a concentration of the higher fatty acid of about 0.01 to 0.1% and supplying onto a conveyor by appropriate method such as coating.

However, lubricating ability of such lubricants comprising the a higher fatty acid soap as the main component is sometimes affected by hard components of the water used. Thus, such lubricants react with hard components of the water used, producing scale, and this scale accumulates on the conveyor surface and decreases the lubrication thereof. Moreover, microorganisms (fungi) inevitably appear in the scale. Yet another problem is that the nozzles for supplying the lubricant are clogged with the scale. Accordingly, Japanese Patent Application Laid-open No. H2-97592 discloses a bactericidal lubricant for transferring bottles and cans, the lubricant comprising a specific anionic surfactant and a bactericidal quaternary ammonium cationic surfactant.

Furthermore, if such lubricants adhere to PET containers for carbonated beverages, because the inside of the container is pressurized by the carbon dioxide gas, stresses appear therein causing stress cracking of the PET container. As a result, there is an unavoidable risk that the PET container will be damaged and that the liquid beverage filling the inside of the container will leak.

Japanese Patent Application Laid-open No. H6-172773 discloses a lubricant for a bottle conveyor for PET containers for a process of filling the containers with a carbonated refreshing beverages, in which an alkyl diphenyl ether disulfonic acid salt is added to a lubricant composition comprising a water-soluble fatty acid alkali salt as the main components, whereby stress cracking of PET containers is prevented or inhibited, while lubricating ability is being maintained.

Further, as a lubricant for resin conveyors, Japanese Patent Application Laid-open No. H10-158681 discloses a lubricant for a bottle conveyor made from a synthetic resin such as polyacetal resin that comprises as the main component an aqueous solution containing 0.0025 wt. % or more of polyethylene glycol-type nonionic surfactants composed of at least one block copolymer of a polyoxyethylene alkyl ether, a polyoxyethylene fatty acid ester, or polyoxyethylene and polyoxypropylene, this lubricant having excellent washing ability and lubricating ability and causing no scale.

However, the problem associated with polyethylene glycol-type nonionic surfactants with HLB 10 to 16 is that they affect stress cracking of PET containers. Furthermore, there is a need for a compact lubricant composition that can be used with a high dilution ratio

DISCLOSURE OF THE INVENTION

With the foregoing in view, an object of the present invention is to provide a lubricant composition for a resin conveyor that has excellent washing ability, lubricant ability, and stability in storage and a method for using same. More particularly, an object of the present invention is to provide a lubricant composition for a resin conveyor that is advantageous for transporting PET containers and has excellent ability to prevent stress cracking and a method for using same.

The inventors have conducted a comprehensive study to attain the aforementioned object, and the results obtained demonstrated that a lubricant for a resin conveyor with excellent washing ability, lubricating ability, and stability in storage can be obtained by using a specific nonionic surfactant as the main component. In particular, the ability to prevent stress cracking is imparted by selecting specific components, thereby making it possible to obtain a lubricant composition for a resin container that is advantageous for transporting PET containers.

Furthermore, adding a specific cationic surfactant and/or amphoteric surfactant makes it possible to obtain a lubricant composition for resin containers also demonstrating an effect (bactericidal effect) of inhibiting microorganism (fungi) generation, without degrading the washing ability, lubricant ability, ability to prevent stress cracking, and stability in storage.

Furthermore, using such lubricant compositions for resin conveyors makes it possible to provide a method of use that is advantageous for transporting PET containers. Those findings led to the creation of the present invention.

Thus, the first main feature of the present invention is in a lubricant composition for a resin conveyor, comprising: (A) at least one species selected from the group of nonionic surfactants represented by the formula (1) shown below and having HLB more than 16; and (B) water.

$$R^1\text{—O-(EO)}n\text{-}R^2 \qquad \text{(Formula 1)}$$

where $R^1$ is a C10 to 20 straight or branched alkyl group, a styrenated phenyl group, or a C9 to 19 acyl group, EO is an ethylene oxide group, n=14 to 100, $R^2$ is hydrogen, a C1 to 3 straight or branched alkyl group or acyl group; —CO—$R^3$, where $R^3$ is C9 to 19 straight or branched alkyl group or alkenyl group.

The second main feature is in the lubricant composition for a resin conveyor in which the compounding ratio of the nonionic surfactant (A) is 0.0025 to 30 wt. % based on the entire composition.

The third main feature is in the lubricant composition for a resin conveyor further comprising: (C) (a) a cationic surfactant and/or (b) an amphoteric surfactant. The fourth main feature is in the lubricant composition for a resin conveyor wherein the cationic surfactant (a), which is one component (C), is at least one species selected from alkyldimethylbenzyl ammonium chloride, didecyldimethyl ammonium chloride, didecyldimethyl ammonium adipate, didecyldimethyl ammonium gluconate, didecylmonomethyl hydroxyethyl ammonium chloride, didecylmonomethyl hydroxyethyl ammonium adipate, didecylmonomethyl hydroxyethyl ammonium gluconate, didecylmonomethyl hydroxyethyl ammonium sulfonate, didecyldimethyl ammonium propionate, hexadecyltributyl phosphonium, and polyhexamethylene biguanide. The fifth main feature is in the lubricant composition for a resin conveyor wherein the amphoteric surfactant (b), which is one component (C), is at least one species selected from lauryl betaine, lauroyl amidopropyl betaine, 2-alkyl-N-carboxymethyl imidazolinium betaine, 2-alkyl-N-carboxyethyl imidazolinium betaine, alkyl aminoethyl glycine, alkyldi(aminoethyl)glycine, glycine n-(3-aminopropyl) $C_{10\ to\ 16}$ derivative, alkylpolyaminoethyl glycine sodium salt or hydrochloride, and coconut fatty acid amidodimethyl hydroxypropyl sulfobetaine.

The sixth main feature is in the lubricant composition for a resin conveyor wherein the compounding ratio of said nonionic surfactant (A) and cationic surfactant (a) and/or amphoteric surfactant (b) is 5:1 to 1:30, as a weight ratio.

The seventh main feature is in the usage method wherein a diluted lubricant liquid obtained by diluting said lubricant composition for a resin conveyor of any one of the above-described features 1 to 6 by using water or hot water within a range of 25 to 1,000 mg/L, as the concentration of the nonionic surfactant, is supplied, sprayed, or applied on a conveyor and used for transporting PET containers.

The eighth main feature is in the usage method wherein together with the diluted lubricant liquid of the seventh feature above, at least one species selected from aqueous solutions of a hypochlorite, peracetic acid, hydrogen peroxide, and iodine at 5 mg/L or more, or chlorine dioxide at 0.05 mg/L or more is supplied, sprayed, or applied on a conveyor, in a mixture or separately, and used for transporting PET containers.

In accordance with the present invention, using a specific nonionic surfactant as the main component makes it possible to obtain a lubricant composition for a resin conveyor that has excellent lubricant ability, washing ability, and stability in storage and is also capable of preventing stress cracking when transporting not only steel cans, aluminum cans, glass bottles, and paper containers, but also PET containers.

Furthermore, adding a specific cationic surfactant and/or amphoteric surfactant makes it possible to obtain a lubricant for resin conveyors that also demonstrates an effect (antibacterial effect) of inhibiting microorganism (fungi) generation, without degrading the washing ability, lubricating ability and stress cracking prevention effect.

Using those lubricant compositions for resin conveyors also can provide a method of use that is advantageous for transporting not only steel cans, aluminum cans, glass bottles, and paper containers, but also PET containers.

BEST MODE FOR CARRYING OUT THE INVENTION

The preferred embodiments of the present invention will be described below in greater detail.

The present invention relates to a lubricant composition for a resin conveyor (referred to hereinbelow as "lubricant composition") comprising a specific nonionic surfactant and optionally a cationic surfactant and/or an amphoteric surfactant and also to a method for using the lubricant composition. The lubricant composition in accordance with the present invention and a method for using same are advantageous for transporting not only steel cans, aluminum cans, glass bottles, and paper containers, but also PET containers.

The nonionic surfactant represented by the formula (1) shown below is used as the nonionic surfactant that is the component (A) employed in the lubricant composition in accordance with the present invention.

$$R^1\text{—O-(EO)}n\text{-}R^2 \qquad \text{(Formula 1)}$$

where $R^1$ is a C10 to 20 straight or branched alkyl group, a styrenated phenyl group, or a C9 to 19 acyl group, EO is an ethylene oxide group, n=14 to 100, $R^2$ is hydrogen, a C1 to 3 straight or branched alkyl group or acyl group; —CO—$R^3$, where $R^3$ is C9 to 19 straight or branched alkyl group or alkenyl group.

Specific examples of such compounds include polyoxyethylene lauryl ether, polyoxyethylene myristyl ether, polyoxyethylene oleyl ether, polyoxyethylene stearyl ether, polyoxyethylene distearyl ether, polyoxyethylene styrenated phenyl ether, polyoxyethylene didecyl ether, polyoxyethylene isodecyl ether, and polyoxyethylene coconut alcohol ether. Those compounds can be readily obtained by chemical synthesis or commercial products can be used, examples thereof including Nonion E-230 (trade name; manufactured by Nippon Oils and Fats Co., Ltd.), Ionet DS-4000 (trade name; manufactured by Sanyo Chemical Industries Co., Ltd.), DSK NL-600 (trade name; manufactured by Daiichi Kogyo Seiyaku KK), Noigen EA-207D (trade name; manufactured by Daiichi Kogyo Seiyaku KK), Noigen XL-1000F (trade name; manufactured by Daiichi Kogyo Seiyaku KK), Noigen XL-140 (trade name; manufactured by Daiichi Kogyo Seiyaku KK), and Pegnol O-24 (trade name; manufactured by Toho Chemical Industry Co., Ltd.).

From the standpoint of stability of the lubricant composition in storage, it is preferred that from among the aforementioned compounds, polyoxyethylene oleyl ether, polyoxyethylene distearyl ether, polyoxyethylene styrenated phenyl ether, and polyoxyethylene isodecyl ether be used.

The nonionic surfactants (A) can be used individually or in combination of two or more thereof. The compounding ratio thereof is set to 0.0025 to 30 wt. % in the lubricant composition. Thus, if the compounding ratio is less than 0.0025 wt. %, the desired lubricating ability cannot be obtained. If the compounding ratio is above 30 wt. %, stability of the lubricant composition in storage (−0° C.) cannot be obtained. Another undesirable consequence is that the composition easily becomes foamy due to disrupted balance with other components.

Pure water ion-exchange water, soft water, distilled water, or tap water can be used as the water component (B)

employed in the lubricant composition in accordance with the present invention. Those types of water can be used individually or in combination of two or more thereof. From the standpoint of cost efficiency and stability in storage, it is preferred that tap water or ion-exchange water be used. The term "water" as used herein is a general term relating to water contained in the form of aqueous solution or water of crystallization derived from various components constituting the lubricant composition in accordance with the present invention and water that is added from the outside. The water is added to obtain 100 wt. % of the entire lubricant composition.

(a) A cationic surfactant and/or (b) an amphoteric surfactant is the component (C) used in the lubricant composition in accordance with the present invention. It is preferred that various quaternary ammonium salts be used as the cationic surfactant (a) which is one component (C), specific examples thereof including alkyl dimethylbenzyl ammonium chlorides, didecyl dimethyl ammonium chloride, didecyl dimethyl ammonium adipate, didecyl dimethyl ammonium gluconate, didecyl monomethyl hydroxyethyl ammonium chloride, didecyl monomethyl hydroxyethyl ammonium adipate, didecyl monomethyl hydroxyethyl ammonium gluconate, didecyl monomethyl hydroxyethyl ammonium sulfonate, didecyl dimethyl ammonium propionate, and hexadecyl tributyl phosphonium. From the standpoint of antibacterial effect intensity, the number of carbon atoms in the alkyl group is set to 10 to 16. Polyhexamethylene biguanide hydrochloride is an example of a biguanide-type cationic surfactant. The aforementioned compounds may be used individually or in combination of two or more thereof.

Examples of commercial cationic surfactants of the aforementioned types include Praepagen HY (trade name, manufactured by Clariant Japan Co., Ltd.), Cation G50 (trade name, manufactured by Sanyo Chemical Industries Co., Ltd.), Proxel IB (trade name, manufactured by Arch Chemical Co., Ltd.), Bardac-2280 (trade name, manufactured by Lonza Japan Co., Ltd.), and Osmolin DA-50 (trade name, manufactured by Sanyo Chemical Industries Co., Ltd.).

Examples of amphoteric surfactant (b) which is one component (C) include amphoteric surfactants of an alkyl betaine type such as lauryl betaine, amphoteric surfactants of an amidobetaine type such as 2-alkyl-N-carboxymethyl imidazolinium betaine, amphoteric surfactants of an imidazoline type such as 2-alkyl-N-carboxyethyl imidazolinium betaine, amphoteric surfactants of alkyl sulfobetaine type, amphoteric surfactants of an amidosulfobetaine type such as coconut fatty acid amidodimethyl hydroxypropyl sulfobetaine, N-alkyl-β-aminopropionates, N-alkyl-β-iminodipropionates, β-alanine-type amphoteric surfactants, glycine n-(3-aminopropyl)-$C_{10\ to\ 16}$ derivatives (trade name: Ampholic-SFB, manufactured by Rhodia Nikka Co., Ltd.), dialkyl di(aminoethyl) glycine (trade name Nissan Anon LG-R, manufactured by Nippon Oils and Fats Co., Ltd.), (trade name Rebon S, manufactured by Sanyo Chemical Industries Co., Ltd.) and other alkyl polyaminoethyl glycine sodium slats or hydrochloric acid salts.

The aforementioned compounds can be used individually or in combination of two or more thereof.

In accordance with the present invention, the cationic surfactant (a) and/or amphoteric surfactant (b) can be used as the component (C), and the (a) and/or (b) of one type each or of two or more types each may be used.

The compounding ratio thereof is set to 0.001 to 30 wt. %, as an effective component quantity, in the lubricant composition. Thus, if the compounding ratio is less than 0.001 wt. %, the desired antibacterial effect cannot be obtained. Furthermore, if the compounding ratio exceeds 30 wt. %, the desired stability of the lubricant composition in storage cannot be obtained due to disrupted balance with other components. Furthermore, this is cost inefficient.

The weight ratio of the nonionic surfactant that is the component (A) and amphoteric surfactant (a) and/or amphoteric surfactant (b) that is the component (C) is A:C=5:1 to 1:30, as the effective component quantity, in the lubricant composition. Furthermore, the content of the [component (A)+component (C)] in the lubricant composition is 0.0035 to 60 wt. %.

When the A:C weight ratio is above 5:1 and the lubricant composition contains a large quantity of the component (A), the bactericidal effect is poor, and when this ratio is more than 1:30 and the lubricant composition contains a large quantity of the component (C), the ability of the lubricant composition to prevent stress creaking is degraded. Furthermore, the lubricant composition has poor stability in storage due to disrupted balance with other components and cost efficiency is poor.

Furthermore, it is undesirable that the content of the [component (A)+component (C)] in the lubricant composition be less than 0.0035 wt. % because the desired lubricating ability cannot be obtained. Furthermore, if this content exceeds 60 wt. %, the desired stability of the lubricant composition in storage cannot be obtained due to disrupted balance with other components and the composition is cost inefficient.

If necessary, the lubricant composition in accordance with the present invention can contain a water-soluble solvent, other bactericidal agents, an anionic surfactant, an antifoaming agent, an additive increasing the clouding point, a washing builder, and the like. Among them, examples of water-soluble solvents include propylene glycol, monoethanolamine, hexylene glycol, diethylene glycol monobutyl ether, ethyl alcohol, isopropyl alcohol, and isoprene glycol. Such a solvent is compounded as a solubilizing agent of the lubricant composition or as a neutralizing agent for acidic components. Furthermore, examples of the anionic surfactant include polyoxyethylene alkyl ether phosphoric acid or polyoxyethylene alkyl ether carboxylic acid and alkali salts thereof. Examples of washing builders include ethylene diamine tetracetic acid, nitrilotriacetic acid, citric acid, malic acid, gluconic acid, iminodiacetic acid, and alkali salts thereof.

When the lubricant composition for a resin conveyor in accordance with the present invention is used, it is employed as a diluted solution of a lubricant that is obtained by diluting with water or hot water so as to obtain an effective component concentration of the component (A) of 25 to 1000 mg/L, for transporting PET containers.

Dilution of the lubricant is usually carried out by using water, and lubricant composition may be used after diluting to the desired usage concentration or a solution diluted to an appropriate concentration may be prepared in advance and then this solution may be further diluted to the desired usage concentration at the time of use.

The diluted solution of the lubricant that was thus prepared can be supplied on a conveyor from a spraying nozzle via a pump or the like, coated by spraying, or applied with a brush or the like.

Employing a method of using by which the diluted solution of the above-described lubricant composition for conveyor and at least one species selected from aqueous solutions of a hypochlorite, peracetic acid, hydrogen peroxide, and iodine at 5 mg/L or more, or chlorine dioxide at 0.05 mg/L or more, are supplied, sprayed, or applied on a conveyor, in a mixture or separately, and used for transporting PET containers makes it possible to provide an even higher bactericidal effect, without decreasing excellent lubricant ability, washing ability, and ability to prevent stress cracking.

As described above, an important feature of the present invention is that it uses a specific nonionic surfactant with HLB above 16.

Furthermore, since the lubricant composition in accordance with the present invention contains no fatty acid soap as the main components, by contrast with conventional lubricant compositions, the advantage thereof is that water quality (mineral components such as calcium and magnesium) of water or hot water used for diluting the lubricant composition and quality of material used produce not effect.

Providing for excellent lubricating ability, washing ability, and stability in storage, and in particular the ability to prevent stress cracking, makes it possible to obtain a lubricant for a resin container that is advantageous for transporting PET containers.

Adding a specific cationic surfactant and/or amphoteric surfactant makes it possible to obtain a lubricant for a resin conveyor that additionally demonstrates the effect (bactericidal effect) inhibiting microorganism (fungi) generation.

EXAMPLES

Examples of the present invention will be explained below together with comparative examples.

Sample lubricant compositions having compositions of Examples 1 to 45 and Comparative Examples 1 to 6 shown in Tables 1 to 11 below (each component in the table is described therein and the numerical units are wt. %) were prepared and evaluated with respect to test items including lubricating ability, washing ability, ability to prevent stress cracking, and stability in storage. Further, an item of bactericidal ability was also evaluated for Examples 18 to 37 and Comparative Examples 1 to 5. The test results are shown in Tables 1 to 11. The test method and evaluation criteria for each item are presented below.

[Test for Lubricating Ability]

Test Method

PET containers for the test were placed on a conveyor plate made from a polyacetal resin, then diluted lubricant solutions prepared by diluting each sample lubricant composition with water to the nonionic surfactant concentration of 25 mg/L were supplied at a rate of 25 mL/min onto the conveyor plate, the friction coefficient (μ) after 10 min was measured, and lubrication ability of each sample was evaluated.

The conveyor speed of the test conveyor was 30 cm/sec and the test bottle was one PET container for the test (weight 1610 g).

The friction coefficient (μ) was calculated by the following formula and evaluated according to the following evaluation criteria:

$$\text{Friction coefficient } (\mu) = [\text{tensile resistance value (g) determined by a spring weight}]/[\text{weight of test bottle (g)}] \quad \text{(Formula 1)}$$

Evaluation Criteria:

○: value of friction coefficient (μ) is less than 0.1 (excellent lubricating ability)

x: value of friction coefficient (μ) is 0.1 or more (poor lubricating ability)

[Test for Washing Ability]

Test Method

The adhesion state of black matter to the conveyor surface after completion of the above-described test for lubricating ability was visually observed and evaluated according to the following evaluation criteria.

Evaluation Criteria

○: no adhesion of contamination was observed x: adhesion of contamination was observed Samples with the evaluation criterion ○ were considered to be suitable for practical use.

[Test for Ability to Prevent Stress Cracking]

Test Method

A PET container with a capacity of 500 mL was filled with carbonated water, and a PET container for testing was obtained by adjusting the pressure to 4.0 to 4.5 gas Vol. (carbon dioxide gas pressure that is 4.0 to 4.5 times the container capacity). Each sample lubricant composition was then diluted with water to obtain the nonionic surfactant concentration of 300 mg/L, the PET containers for testing were immersed by three containers at a time into the diluted lubricant solution so as to obtain a semi-immersed state and were then allowed to stay for 10 days at a temperature of 40° C. and a humidity of 80%. The appearance of cracks in the PET containers was then visually observed and evaluated according to the following criteria. In Examples 1 to 16 the concentration of nonionic surfactant was 25 mg/L, and in Comparative Example 1, a solution obtained by 100-fold dilution was used for the test.

Evaluation Criteria

A: absolutely or practically no cracks appeared.

B: very few or almost no small cracks appeared.

C: large cracks could be observed.

D: a large number of large cracks have appeared.

Samples with the evaluation criteria A and B were considered to be suitable for practical use.

[Test for Stability in Storage]

Test Method

A total of 500 mL of each sample lubricant composition was placed into a glass container with a capacity of 500 mL and the containers were sealed, allowed to stay for 10 days in an incubator (Bytech 500, manufactured by Shimazu Co., Ltd.) that was set to 0° C. and at room temperature and then visually evaluated according to the following evaluation criteria.

Evaluation Criteria

○: the composition is uniformly transparent and no solidification or separation is observed at room temperature and at 0° C.

Δ: the composition is uniformly transparent at room temperature by slight solidification or separation is observed at 0° C.

x: solidification and separation are observed at room temperature and 0° C.

Samples with the evaluation criteria ○ and Δ were considered to be suitable for practical use.

[Test for Bactericidal Ability]

Test Method

According to European standard test method EN 1040, diluted lubricant solutions were prepared by diluting each sample lubricant composition with pure water to a nonionic surfactant concentration of 25 mg/L, and *Coli* bacteria and

*Pseudomonas aeruginosa* were brought into contact with each diluted solution for 10 min and seeded into the liquid cultures. Evaluation was conducted according to the following criteria from the logarithmic decrement value of the number of bacteria after cultivation for 48 h at 37° C.

Evaluation Criteria

○: logarithmic decrement value of the initial number of bacteria was 5 log or more (excellent bactericidal ability).

x: logarithmic decrement value of the initial number of bacteria was less than 5 log (poor bactericidal ability).

Component (A)

Nonionic Surfactant 1
EO 30 mol adduct of higher alcohol (HLB=16.6)
Trade name: Nonion E-230, manufactured by Nippon Oils and Fats Co., Ltd. (effect component 100%).

Nonionic Surfactant 2
EO 75 mol adduct of distearyl alcohol (HLB=18.0)
Trade name: Ionet DS-4000, manufactured by Sanyo Chemical Industries Co., Ltd. (effective component 100%).

Nonionic Surfactant 3
EO 52 mol adduct of lauryl alcohol (HLB=18.6)
Trade name: DSK NL-600, manufactured by Daiichi Kogyo Seiyaku KK (effective component 100%).

Nonionic Surfactant 4
EO 98 mol adduct of styrenated phenyl alcohol (HLB=18.7)
Trade name: Noigen EA-207D, manufactured by Daiichi Kogyo Seiyaku KK (effective component 100%).

Nonionic Surfactant 5
EO 100 mol adduct of isodecyl alcohol (HLB=19.3)
Trade name: Noigen XL-1000F, manufactured by Daiichi Kogyo Seiyaku KK (effective component 100%).

Nonionic Surfactant 6
EO 14 mol adduct of higher alcohol (HLB=16.1)
Trade name: Noigen XL-140, manufactured by Daiichi Kogyo Seiyaku KK (effective component 100%).

Nonionic Surfactant 7
EO 24 mol adduct of higher alcohol (HLB=16.6)
Trade name: Pegnol O-24, manufactured by Toho Chemical Industry Co., Ltd. (effective component 100%).

Nonionic Surfactant 8 (for Comparative Examples)
EO 10 mol adduct of higher alcohol (HLB=12.4)
Trade name: Nonion E-210C, manufactured by Nippon Oils and fats Co., Ltd. (effective component 100%).

Component (C)

Cationic Surfactant 1
Alkyl dimethyl hydroxyethyl ammonium salt: C12 to 14 alkyl dimethyl hydroxyethyl ammonium chloride
Trade name: Praepagen HY (manufactured by Clariant Japan Co., Ltd.; effective component 40 wt. %).

Cationic Surfactant 2
Chlorinated benzoalkonium: C12 to 14 dimethyl benzyl ammonium chloride
Trade name: Cation G50 (manufactured by Sanyo Chemical Industries Co., Ltd.; effective component 50 wt. %).

Cationic Surfactant 3
Polyhexamethylene biguanide hydrochloride: poly (n=12) hexamethylene biguanide hydrochloride
Trade name: Prochel IB (manufactured by Arch Chemical Co., Ltd.; effective component 20 wt. %).

Cationic Surfactant 4
Didecyldimethyl ammonium chloride: didecyl dimethyl ammonium chloride
Trade name: Bardac-2280 (manufactured by Lonza Japan Co. Ltd.; effective component 80 wt. %).

Cationic Surfactant 5
Didecyldimethyl ammonium adipate: didecyl dimethyl ammonium adipate
Trade name: Osmolin DA-50 (manufactured by Sanyo Chemical Industries Co., Ltd.; effective component 48 wt. %).

Amphoteric Surfactant 1
Diaminodiethyl glycine
Trade name: Nissan Anon LG-R (manufactured by Nippon Oils and Fats Col, Ltd.; effective component 30 wt. %).

Amphoteric Surfactant 2
Alkyl glycine
Trade name: Rebon S (manufactured by Sanyo Chemical Industries Co., Ltd.; effective component 30 wt. %).

[Randomly Added Components]

Water-Soluble Solvent 1
Propylene glycol
Trade name: Adeca Propylene Glycol (PG), manufactured by Asahi Denka KK.

Water-Soluble Solvent 2
Monoethanolamine
Trade name: Monoethanolamine (MEA), manufactured by Nippon Shokubai KK.

Water-Soluble Solvent 3
Ethyl alcohol
Trade name: Ethyl alcohol (Reagent Grade 1), manufactured by Kanto Kagaku KK.

Water-Soluble Solvent 4
Metaxylenesulfonic acid sodium
Trade name: Teikatox 110, manufactured by Teika KK Washing Builder
Ethylene amine tetracetic acid triammonium
Trade name: Chirest 3N, manufactured by Chirest KK.

Anionic Surfactant 1
Polyoxyethylene ether phosphate
Trade name: Phosphanol RA-600, manufactured by Toho Chemical Industry Co., Ltd., effective component 50 wt. %.

Anionic Surfactant 2
Polyoxyethylene lauryl ether acetic acid sodium
Trade name: View Light LCA 30D, manufactured by Sanyo Chemical Industries Co., Ltd., effective component 29 wt. %.

TABLE 1

| | | Examples | | | | |
|---|---|---|---|---|---|---|
| | | 1 | 2 | 3 | 4 | 5 |
| A | Nonionic surfactant 1 | 0.0025 | 1.0 | 3.0 | 6.0 | 12.0 |
| | Nonionic surfactant 2 | | | | | |
| | Nonionic surfactant 3 | | | | | |
| | Nonionic surfactant 4 | | | | | |

TABLE 1-continued

| | | Examples | | | | |
|---|---|---|---|---|---|---|
| | | 1 | 2 | 3 | 4 | 5 |
| | Nonionic surfactant 5 | | | | | |
| | Nonionic surfactant 6 | | | | | |
| | Nonionic surfactant 7 | | | | | |
| B | Water | Balance | Balance | Balance | Balance | Balance |
| | Total | 100.0 | 100.0 | 100.0 | 100.0 | 100.0 |
| Test results | Lubricating ability | ○ | ○ | ○ | ○ | ○ |
| | Washing ability | ○ | ○ | ○ | ○ | ○ |
| | Ability to prevent stress cracking | A | A | A | A | A |
| | Stability in storage | ○ | ○ | ○ | ○ | ○ |

TABLE 2

| | | Examples | | | | |
|---|---|---|---|---|---|---|
| | | 6 | 7 | 8 | 9 | 10 |
| A | Nonionic surfactant 1 | 20.0 | 30.0 | | | |
| | Nonionic surfactant 2 | | | 3.0 | | |
| | Nonionic surfactant 3 | | | | 3.0 | |
| | Nonionic surfactant 4 | | | | | 3.0 |
| | Nonionic surfactant 5 | | | | | |
| | Nonionic surfactant 6 | | | | | |
| | Nonionic surfactant 7 | | | | | |
| B | Water | Balance | Balance | Balance | Balance | Balance |
| Random components | Water-soluble solvent 1 | | | | | |
| | Water-soluble solvent 2 | | | | | |
| | Water-soluble solvent 3 | | 35.0 | | | |
| | Water-soluble solvent 4 | | | | | |
| | Total | 100.0 | 100.0 | 100.0 | 100.0 | 100.0 |
| Test results | Lubricating ability | ○ | ○ | ○ | ○ | ○ |
| | Washing ability | ○ | ○ | ○ | ○ | ○ |
| | Ability to prevent stress cracking | A | A | A | A | A |
| | Stability in storage | ○ | ○ | ○ | ○ | ○ |

TABLE 3

| | | Examples | | | | |
|---|---|---|---|---|---|---|
| | | 11 | 12 | 13 | 14 | 15 |
| A | Nonionic surfactant 1 | | | | 3.0 | |
| | Nonionic surfactant 2 | | | | | 3.0 |
| | Nonionic surfactant 3 | | | | 2.0 | |
| | Nonionic surfactant 4 | | | | | 1.0 |
| | Nonionic surfactant 5 | 3.0 | | | | |
| | Nonionic surfactant 6 | | 3.0 | | | |
| | Nonionic surfactant 7 | | | 3.0 | | 1.0 |
| B | Water | Balance | Balance | Balance | Balance | Balance |
| | Total | 100.0 | 100.0 | 100.0 | 100.0 | 100.0 |
| Test results | Lubricating ability | ○ | ○ | ○ | ○ | ○ |
| | Washing ability | ○ | ○ | ○ | ○ | ○ |
| | Ability to prevent stress cracking | A | A | A | A | A |
| | Stability in storage | ○ | ○ | ○ | ○ | ○ |

TABLE 4

| | | Examples | | | | |
|---|---|---|---|---|---|---|
| | | 16 | 17 | 18 | 19 | 20 |
| A | Nonionic surfactant 1 | 5.0 | 2.0 | 0.0025 | 1.0 | 3.0 |
| | Nonionic surfactant 2 | 2.0 | 1.5 | | | |
| | Nonionic surfactant 3 | | | | | |
| | Nonionic surfactant 4 | | 1.0 | | | |
| | Nonionic surfactant 5 | | 1.0 | | | |
| | Nonionic surfactant 6 | | | | | |
| | Nonionic surfactant 7 | | 1.0 | | | |
| B | Water | Balance | Balance | Balance | Balance | Balance |
| C | Cationic surfactant 1 | | | | | |
| | Cationic surfactant 2 | | | | | 6.0 |
| | Cationic surfactant 3 | | | 0.0050 | | |
| | Cationic surfactant 4 | | | | 37.5 | |
| | Cationic surfactant 5 | | | | | |
| | Amphoteric surfactant 1 | | | | | |
| | Amphoteric surfactant 2 | | | | | |
| | Total | 100.0 | 100.0 | 100.0 | 100.0 | 100.0 |
| A:C weight ratio | | — | — | 5:2 | 1:30 | 1:1 |
| A + C effective component quantity (wt. %) | | — | — | 0.0035 | 31.0 | 6.0 |
| Test results | Lubricating ability | ○ | ○ | ○ | ○ | ○ |

TABLE 4-continued

| | | Examples | | | | |
|---|---|---|---|---|---|---|
| | | 16 | 17 | 18 | 19 | 20 |
| | Washing ability | ○ | ○ | ○ | ○ | ○ |
| | Ability to prevent stress cracking | A | A | A | B | A |
| | Stability in storage | ○ | ○ | ○ | ○ | ○ |
| | Bactericidal ability | — | — | ○ | ○ | ○ |

TABLE 5

| | | Examples | | | | |
|---|---|---|---|---|---|---|
| | | 21 | 22 | 23 | 24 | 25 |
| A | Nonionic surfactant 1 | 6.0 | 12.0 | 20.0 | 30.0 | |
| | Nonionic surfactant 2 | | | | | 3.2 |
| | Nonionic surfactant 3 | | | | | |
| | Nonionic surfactant 4 | | | | | |
| | Nonionic surfactant 5 | | | | | |
| | Nonionic surfactant 6 | | | | | |
| | Nonionic surfactant 7 | | | | | |
| B | Water | Balance | Balance | Balance | Balance | Balance |
| C | Cationic surfactant 1 | | | | | |
| | Cationic surfactant 2 | | | | | |
| | Cationic surfactant 3 | | | 25.0 | | |
| | Cationic surfactant 4 | 37.5 | | | 37.5 | 2.0 |
| | Cationic surfactant 5 | | 75.0 | | | |
| | Amphoteric surfactant 1 | | | | | |
| | Amphoteric surfactant 2 | | | | | |
| Random components | Water-soluble solvent 1 | | 10.0 | | | |
| | Water-soluble solvent 2 | | | | | |
| | Water-soluble solvent 3 | | | | | |
| | Water-soluble solvent 4 | | | | | |
| | Total | 100.0 | 100.0 | 100.0 | 100.0 | 100.0 |
| A:C weight ratio | | 1:5 | 1:3 | 4:1 | 1:1 | 2:1 |
| A + C effective component quantity (wt. %) | | 36.0 | 48.0 | 25.0 | 60.0 | 4.8 |
| Test results | Lubricating ability | ○ | ○ | ○ | ○ | ○ |
| | Washing ability | ○ | ○ | ○ | ○ | ○ |
| | Ability to prevent stress cracking | A | A | A | A | A |

TABLE 5-continued

| | | Examples | | | | |
|---|---|---|---|---|---|---|
| | | 21 | 22 | 23 | 24 | 25 |
| | Stability in storage | ○ | ○ | ○ | ○ | ○ |
| | Bactericidal ability | ○ | ○ | ○ | ○ | ○ |

TABLE 6

| | | Examples | | | | |
|---|---|---|---|---|---|---|
| | | 26 | 27 | 28 | 29 | 30 |
| A | Nonionic surfactant 1 | | | | | |
| | Nonionic surfactant 2 | | | | | |
| | Nonionic surfactant 3 | 3.2 | | | | |
| | Nonionic surfactant 4 | | 3.2 | | | |
| | Nonionic surfactant 5 | | | 3.2 | | |
| | Nonionic surfactant 6 | | | | 3.2 | |
| | Nonionic surfactant 7 | | | | | 3.2 |
| B | Water | Balance | Balance | Balance | Balance | Balance |
| C | Cationic surfactant 1 | | | | | |
| | Cationic surfactant 2 | | | | | |
| | Cationic surfactant 3 | | | | | |
| | Cationic surfactant 4 | 2.0 | 2.0 | 2.0 | 2.0 | 2.0 |
| | Cationic surfactant 5 | | | | | |
| | Amphoteric surfactant 1 | | | | | |
| | Amphoteric surfactant 2 | | | | | |
| Random components | Water-soluble solvent 1 | | | | | |
| | Water-soluble solvent 2 | | | | | |
| | Water-soluble solvent 3 | | | | | |
| | Water-soluble solvent 4 | | | | | |
| | Total | 100.0 | 100.0 | 100.0 | 100.0 | 100.0 |
| A:C Weight ratio | | 2:1 | 2:1 | 2:1 | 2:1 | 2:1 |
| A + C effective component quantity (wt. %) | | 4.8 | 4.8 | 4.8 | 4.8 | 4.8 |
| Test results | Lubricating ability | ○ | ○ | ○ | ○ | ○ |
| | washing ability | ○ | ○ | ○ | ○ | ○ |
| | Ability to prevent stress cracking | A | A | A | A | A |
| | Stability in storage | ○ | ○ | ○ | ○ | ○ |
| | Bactericidal ability | ○ | ○ | ○ | ○ | ○ |

TABLE 7

| | | Examples | | | | |
|---|---|---|---|---|---|---|
| | | 31 | 32 | 33 | 34 | 35 |
| A | Nonionic surfactant 1 | 3.0 | | 5.0 | 1.0 | |
| | Nonionic surfactant 2 | | 3.0 | 2.2 | 2.0 | 3.0 |
| | Nonionic surfactant 3 | 2.0 | | | | |
| | Nonionic surfactant 4 | | 1.0 | | | 1.0 |
| | Nonionic surfactant 5 | | | | 1.0 | 1.0 |
| | Nonionic surfactant 6 | | | | 1.0 | |
| | Nonionic surfactant 7 | | 1.0 | | 2.0 | |
| B | Water | Balance | Balance | Balance | Balance | Balance |
| C | Cationic surfactant 1 | | 2.5 | | | 30.0 |
| | Cationic surfactant 2 | 2.2 | | | 7.0 | |
| | Cationic surfactant 3 | | | | | |
| | Cationic surfactant 4 | | | 3.0 | | |
| | Cationic surfactant 5 | | | | | |
| | Amphoteric surfactant 1 | | | | | |
| | Amphoteric surfactant 2 | | | | | |
| Random components | Water-soluble solvent 1 | | | | | |
| | Water-soluble solvent 2 | | | | | 1.0 |
| | Water-soluble solvent 3 | | | | | |
| | Water-soluble solvent 4 | | | | | |
| | Washing builder | | | | | 8.0 |
| | Anionic surfactant 1 | | | | | 7.0 |
| | Anionic surfactant 2 | | | | | |
| | Total | 100.0 | 100.0 | 100.0 | 100.0 | 100.0 |
| A:C weight ratio | | 10:7 | 5:1 | 3:1 | 2:1 | 5:12 |
| A + C effective component quantity (wt. %) | | 8.5 | 6.0 | 9.6 | 10.5 | 17.0 |
| Test results | Lubricating ability | ○ | ○ | ○ | ○ | ○ |
| | Washing ability | ○ | ○ | ○ | ○ | ○ |
| | Ability to prevent stress cracking | A | A | A | A | A |
| | Stability in storage | ○ | ○ | ○ | ○ | ○ |
| | Bactericidal ability | ○ | ○ | ○ | ○ | ○ |

TABLE 8

| | | Examples | | | | |
|---|---|---|---|---|---|---|
| | | 36 | 37 | 38 | 39 | 40 |
| A | Nonionic surfactant 1 | 3.2 | | | 3.0 | 1.0 |
| | Nonionic surfactant 2 | | | | | |
| | Nonionic surfactant 3 | | | | | |
| | Nonionic surfactant 4 | | | | | 1.0 |
| | Nonionic surfactant 5 | | | | | |
| | Nonionic surfactant 6 | | | | | |
| | Nonionic surfactant 7 | | 3.0 | 3.0 | | 1.0 |
| B | Water | Balance | Balance | Balance | Balance | Balance |
| C | Cationic surfactant 1 | | | | | |
| | Cationic surfactant 2 | | | | | |
| | Cationic surfactant 3 | | 8.0 | | | |
| | Cationic surfactant 4 | 2.0 | | | | |
| | Cationic surfactant 5 | | | | | |
| | Amphoteric surfactant 1 | | | 5.0 | 5.0 | 5.0 |
| | Amphoteric surfactant 2 | | | | | |
| Random components | Water-soluble solvent 1 | 7.0. | 15.0 | 15.0 | 15.0 | 15.0 |
| | Water-soluble solvent 2 | | | | | |
| | Water-soluble solvent 3 | | | | | |
| | Water-soluble solvent 4 | | 1.0 | 1.0 | 1.0 | 1.0 |
| | Washing builder | | | | | |
| | Anionic surfactant 1 | | | | | |
| | Anionic surfactant 2 | 10.0 | | | | |
| | Total | 100.0 | 100.0 | 100.0 | 100.0 | 100.0 |
| A:C weight ratio | | 2:1 | 15:8 | 2:1 | 2:1 | 2:1 |
| A + C effective component quantity (wt. %) | | 4.8 | 4.6 | 4.5 | 4.5 | 4.5 |
| Test results | Lubricating ability | ○ | ○ | ○ | ○ | ○ |
| | Washing ability | ○ | ○ | ○ | ○ | ○ |
| | Ability to prevent stress cracking | A | A | A | A | A |
| | Stability in storage | ○ | ○ | ○ | ○ | ○ |
| | Bactericidal ability | ○ | ○ | — | — | — |

TABLE 9

| | | Examples | | | | |
|---|---|---|---|---|---|---|
| | | 41 | 42 | 43 | 44 | 45 |
| A | Nonionic surfactant 1 | 6.0 | | 3.0 | 4.0 | |
| | Nonionic surfactant 2 | | 1.0 | | | 2.0 |
| | Nonionic surfactant 3 | | 1.0 | | | 1.0 |
| | Nonionic surfactant 4 | | | | | 1.0 |
| | Nonionic surfactant 5 | | 1.0 | | 1.0 | |
| | Nonionic surfactant 6 | | | | | 1.0 |
| | Nonionic surfactant 7 | | 3.0 | 3.0 | | |
| B | Water | Balance | Balance | Balance | Balance | Balance |
| C | Cationic surfactant 1 | | | | | |
| | Cationic surfactant 2 | | | | | |
| | Cationic surfactant 3 | | | | | |
| | Cationic surfactant 4 | | | | | |
| | Cationic surfactant 5 | | | | | |
| | Amphoteric surfactant 1 | 5.0 | 5.0 | 5.0 | 5.0 | 4.0 |
| | Amphoteric surfactant 2 | | | | | 2.0 |
| Random components | Water-soluble solvent 1 | 15.0 | 15.0 | 15.0 | 15.0 | 14.5 |
| | Water-soluble solvent 2 | | | | | |
| | Water-soluble solvent 3 | | | | | |
| | Water-soluble solvent 4 | 1.0 | 1.0 | 1.0 | 1.0 | 1.0 |
| | Washing builder | | | | 2.0 | |
| | Anionic surfactant 1 | | | | | 5.0 |
| | Anionic surfactant 2 | | | | | |
| | Total | 100.0 | 100.0 | 100.0 | 100.0 | 100.0 |
| A:C weight ratio | | 2:1 | 2:1 | 4:1 | 10:3 | 25:9 |
| A + C effective component quantity (wt. %) | | 7.5 | 7.5 | 7.5 | 6.5 | 6.8 |
| Test results | Lubricating ability | ○ | ○ | ○ | ○ | ○ |
| | Washing ability | ○ | ○ | ○ | ○ | ○ |
| | Ability to prevent stress cracking | A | A | A | A | A |
| | Stability in storage | ○ | ○ | ○ | ○ | ○ |
| | Bactericidal ability | — | — | — | — | — |

TABLE 10

| | | Comparative Examples | | | | |
|---|---|---|---|---|---|---|
| | | 1 | 2 | 3 | 4 | 5 |
| A | Nonionic surfactant 1 | | 7.0 | | | |
| | Nonionic surfactant 2 | | | 1.0 | | |
| | Nonionic surfactant 3 | | | | | 1.0 |
| | Nonionic surfactant 4 | | | | 7.0 | |
| | Nonionic surfactant 5 | | | | | |
| | Nonionic surfactant 6 | | | | | |
| | Nonionic surfactant 7 | | | | | |
| B | Water | Balance | Balance | Balance | Balance | Balance |
| C | Cationic surfactant 1 | | 2.5 | | 2.5 | |
| | Cationic surfactant 2 | 6.0 | | | | |
| | Cationic surfactant 3 | | | | | |
| | Cationic surfactant 4 | | | 50.0 | | 50.0 |
| | Cationic surfactant 5 | | | | | |
| Random components | Water-soluble solvent 1 | | | | 5.0 | 7.0 |
| | Water-soluble solvent 2 | | | | 1.5 | |
| | Washing builder | | | | 8.0 | |
| | Anionic surfactant 1 | | | | 5.0 | |
| | Anionic surfactant 2 | | | | | 5.0 |
| | Total | 100.0 | 100.0 | 100.0 | 100.0 | 100.0 |
| A:C Weight ratio | | — | 7:1 | 1:40 | 7:1 | 1:40 |
| A + C effective component quantity (wt. %) | | 6.0 | 8.0 | 41.0 | 8.0 | 41.0 |
| Test results | Lubricating ability | x | ○ | ○ | ○ | ○ |
| | Washing ability | ○ | ○ | ○ | ○ | ○ |
| | Ability to prevent stress cracking | C | B | C | B | C |
| | Stability in storage | ○ | ○ | x | ○ | x |
| | Bactericidal ability | ○ | x | ○ | x | ○ |

TABLE 11

| | | Comparative Examples 6 |
|---|---|---|
| A | Nonionic surfactant 1 | |
| | Nonionic surfactant 2 | |
| | Nonionic surfactant 3 | |
| | Nonionic surfactant 4 | |
| | Nonionic surfactant 5 | |
| | Nonionic surfactant 6 | |
| | Nonionic surfactant 7 | |
| | Nonionic surfactant 8 | 3.0 |
| B | Water | Balance |
| C | Cationic surfactant 1 | |
| | Cationic surfactant 2 | |

TABLE 11-continued

| | | Comparative Examples 6 |
|---|---|---|
| | Cationic surfactant 3 | |
| | Cationic surfactant 4 | |
| | Cationic surfactant 5 | |
| | Amphoteric surfactant 1 | 5.0 |
| | Amphoteric surfactant 2 | |
| Random components | Water-soluble solvent 1 | 15.0 |
| | Water-soluble solvent 2 | |
| | Water-soluble solvent 3 | |
| | Water-soluble solvent 4 | 1.0 |
| | Washing builder | |
| | Anionic surfactant 1 | |
| | Anionic surfactant 2 | |
| | Total | 100.0 |
| | A:C weight ratio | 2:1 |
| | A + C effective component quantity (wt. %) | 4.5 |
| Test results | Lubricating ability | ○ |
| | Washing ability | ○ |
| | Ability to prevent stress cracking | ○ |
| | Stability in storage | ○ |
| | Bactericidal ability | — |

The results presented in Tables 1 to 11 demonstrate that all the products of Examples 1 to 45 of the lubricant composition for a resin conveyor in accordance with the present invention demonstrate excellent lubricating ability, washing ability, ability to prevent stress cracking, and stability in storage. It is also clear that the lubricant compositions for a resin conveyor of Examples 18 to 37 also excel in bactericidal ability.

On the other hand, it is clear than when the nonionic surfactant that is the component (A) is not present, as in Comparative Example 1, lubricating ability and ability to prevent stress cracking are degraded. Comparative Examples 2 and 4 relate to the case where in the weight ratio of component (A) and component (C), the component (A) is outside and above the specific range. In this case, bactericidal ability is degraded. Comparative Examples 3 and 5 relate to the case where in the weight ratio of component (A) and component (C), the component (C) is outside and above the specific range. In this case, stability in storage and ability to prevent stress cracking are degraded.

Furthermore, Comparative Example 6 relates to the case where the HLB value of the nonionic surfactant that is the component (A) is 16 or less. In this case, ability to prevent stress cracking is degraded.

The invention claimed is:

1. A lubricant composition for a resin conveyor, comprising: (A) at least one species selected from the group of nonionic surfactants represented by the formula (1) shown below and having HLB more than 16; and (B) water, $$R^1—O-(EO)n-R^2 \quad \text{(Formula 1)}$$

where $R^1$ is a C10-20 straight or branched alkyl group, a styrenated phenyl group, or a C9-19 acyl group, EO is an ethylene oxide group, n=14-100, $R^2$ is hydrogen, a C1-3 straight or branched alkyl group or acyl group; —CO—$R^3$, where $R^3$ is C9-19 straight or branched alkyl group or alkenyl group.

2. The lubricant composition for a resin conveyor according to claim 1, wherein the compounding ratio of said nonionic surfactant (A) is 0.0025-30 wt. % based on the entire composition.

3. The lubricant composition for a resin conveyor according to claim 1, further comprising: (C) (a) a cationic surfactant and/or (b) an amphoteric surfactant.

4. The lubricant composition for a resin conveyor according to claim 3, wherein the cationic surfactant (a), which is one said component (C) is at least one species selected from alkyldimethylbenzyl ammonium chloride, didecyldimethyl ammonium chloride, didecyldimethyl ammonium adipate, didecyldimethyl ammonium gluconate, didecylmonomethyl hydroxyethyl ammonium chloride, didecylmonomethyl hydroxyethyl ammonium adipate, didecylmonomethyl hydroxyethyl ammonium gluconate, didecylmonomethyl hydroxyethyl ammonium sulfonate, didecyldimethyl ammonium propionate, hexadecyltributyl phosphonium, and polyhexamethylene biguanide.

5. The lubricant composition for a resin conveyor according to claim 3, wherein the amphoteric surfactant (b), which is one said component (C) is at least one species selected from lauryl betaine, lauroyl amidopropyl betaine, 2-alkyl-N-carboxymethyl imidazolinium betaine, 2-alkyl-N-carboxyethyl imidazolinium betaine, alkyl aminoethyl glycine, alkyldi(aminoethyl)glycine, glycine n-(3-aminopropyl) $C_{10-16}$ derivative, alkylpolyaminoethyl glycine sodium salt or hydrochloride, and coconut fatty acid amidodimethyl hydroxypropyl sulfobetaine.

6. The lubricant composition for a resin conveyor according to claim 3, wherein the compounding ratio of said nonionic surfactant (A) and cationic surfactant (a) and/or amphoteric surfactant (b) is 5:1 to 1:30, as a weight ratio.

7. A usage method wherein a diluted lubricant liquid obtained by diluting said lubricant composition for a resin conveyor according to claim 1 by using water or hot water within a range of 25-1,000 mg/L, as the concentration of the nonionic surfactant, is supplied, sprayed, or applied on a conveyor and used for transporting PET containers.

8. A usage method wherein, together with said diluted lubricant liquid according to claim 7, at least one species selected from aqueous solutions of a hypochlorite, peracetic acid, hydrogen peroxide, and iodine at 5 mg/L or more, or chlorine dioxide at 0.05 mg/L or more is supplied, sprayed, or applied on a conveyor, in a mixture or separately, and used for transporting PET containers.

9. A lubricant composition for a resin conveyor, comprising: (A) at least one species selected from the group of nonionic surfactants represented by the formula (1) shown below and having HLB more than 16; and (B) water, $$R^1—O-(EO)n-R^2 \quad \text{(Formula 1)}$$

where $R^1$ is a C10-20 straight or branched alkyl group, a styrenated phenyl group, or a C9-19 acyl group, EO is an ethylene oxide group, n=14-100, $R^2$ is hydrogen, a C1-3 straight or branched alkyl group or acyl group; —CO—$R^3$, where $R^3$ is C9-19 straight or branched alkyl group or alkenyl group; and further comprising: (C) (a) a cationic surfactant and/or (b) an amphoteric surfactant;

wherein the amphoteric surfactant (b), is at least one species selected from lauryl betaine, lauroyl amidopropyl betaine, 2-alkyl-N-carboxymethyl imidazolinium betaine, 2-alkyl-N-carboxyethyl imidazolinium betaine, alkyl aminoethyl glycine, alkyldi(aminoethyl)glycine, glycine n-(3-aminopropyl)$C_{10-16}$ derivative, alkylpolyaminoethyl glycine sodium salt or hydrochloride, and coconut fatty acid amidodimethyl hydroxypropyl sulfobetaine.

10. The lubricant composition for a resin conveyor according to claim 9, wherein the compounding ratio of said nonionic surfactant (A) is 0.0025-30 wt. % based on the entire composition.

11. The lubricant composition for a resin conveyor according to claim 9, wherein the cationic surfactant (a), which is one said component (C) is at least one species selected from alkyldimethylbenzyl ammonium chloride, didecyldimethyl ammonium chloride, didecyldimethyl ammonium adipate, didecyldimethyl ammonium gluconate, didecylmonomethyl hydroxyethyl ammonium chloride, didecylmonomethyl hydroxyethyl ammonium adipate, didecylmonomethyl hydroxyethyl ammonium gluconate, didecylmonomethyl hydroxyethyl ammonium sulfonate, didecyldimethyl ammonium propionate, hexadecyltributyl phosphonium, and polyhexamethylene biguanide.

12. The lubricant composition for a resin conveyor according to claim 9, wherein the compounding ratio of said nonionic surfactant (A) and cationic surfactant (a) and/or amphoteric surfactant (b) is 5:1 to 1:30, as a weight ratio.

13. A usage method wherein a diluted lubricant liquid obtained by diluting said lubricant composition for a resin conveyor according to claim 9 by using water or hot water within a range of 25-1,000 mg/L, as the concentration of the nonionic surfactant, is supplied, sprayed, or applied on a conveyor and used for transporting PET containers.

14. A usage method wherein, together with said diluted lubricant liquid according to claim 13, at least one species selected from aqueous solutions of a hypochlorite, peracetic acid, hydrogen peroxide, and iodine at 5 mg/L or more, or chlorine dioxide at 0.05 mg/L or more is supplied, sprayed, or applied on a conveyor, in a mixture or separately, and used for transporting PET containers.

* * * * *